US007232327B2

(12) United States Patent
Asai et al.

(10) Patent No.: US 7,232,327 B2
(45) Date of Patent: Jun. 19, 2007

(54) SOCKET FOR ATTACHING AN ELECTRONIC COMPONENT

(75) Inventors: Kiyoshi Asai, Tokyo (JP); Kazuaki Kanazawa, Tokyo (JP); Junichi Kobayashi, Tokyo (JP)

(73) Assignee: SMK Corporation, Tokyo (JP)

( * ) Notice: Subject to any disclaimer, the term of this patent is extended or adjusted under 35 U.S.C. 154(b) by 26 days.

(21) Appl. No.: 11/007,717

(22) Filed: Dec. 7, 2004

(65) Prior Publication Data

US 2005/0215118 A1 Sep. 29, 2005

(30) Foreign Application Priority Data

Mar. 25, 2004 (JP) ..... 2004-088388

(51) Int. Cl.
*H01R 13/62* (2006.01)

(52) U.S. Cl. ..... 439/331

(58) Field of Classification Search ..... 439/331, 439/73, 342, 70, 71, 66
See application file for complete search history.

(56) References Cited

U.S. PATENT DOCUMENTS 4,511,201 A * 4/1985 Baker et al. ..... 439/71
5,163,837 A * 11/1992 Rowlette, Sr. ..... 439/331
5,364,278 A * 11/1994 Laub ..... 439/73
5,490,795 A * 2/1996 Hetzel et al. ..... 439/331
6,964,573 B2 * 11/2005 Asai et al. ..... 439/71
7,097,466 B2 * 8/2006 Asai ..... 439/76.1

FOREIGN PATENT DOCUMENTS

JP 2003-092168 3/2003

OTHER PUBLICATIONS

Patent Abstracts of Japan for JP2003-092168 published on Mar. 28, 2003.

* cited by examiner

*Primary Examiner*—Felix O. Figueroa
(74) *Attorney, Agent, or Firm*—Darby & Darby

(57) ABSTRACT

An electronic part attachment socket includes a socket housing including an electronic part housing section with an open top into which all or part of an electronic part is housed; and contacts are supported by a socket housing and form an elastic contact with the terminal sections of the electronic part. The electronic part is connected to a printed circuit substrate by way of the contacts. A shield case is formed in a box shape that fits to the outer perimeter of the socket housing, and is formed integrally with a pushing section that projects inward. The shield case is fitted to the socket housing so that it is prevented from slipping off so that the pushing section pushes the electronic part toward the contacts, resulting in the electronic part being housed in the electronic part housing section.

2 Claims, 10 Drawing Sheets

SOCKET FOR ATTACHING AN ELECTRONIC COMPONENT

INCORPORATION BY REFERENCE

The present application claims priority under 35 U.S.C. §119 to Japanese Patent Application No. 2004-088388 filed on Mar. 25, 2004. The content of the application is incorporated herein by reference in its entirety.

FIELD OF THE INVENTION

The present invention relates to a socket for attaching an electronic part primarily for attaching an electronic part such as a camera modules to a printed circuit substrate.

BACKGROUND OF THE INVENTION

Conventionally, in electronic devices such as portable telephones, a printed circuit substrate is installed internally and electronic parts such as camera modules are attached to the printed circuit substrate. Since electronic parts that are heat-sensitive cannot be attached directly with solder, a socket for attaching electronic parts such as shown in FIG. 14 is used for connecting the part to the printed circuit substrate.

The prior art electronic part attachment socket 1 is equipped with a socket housing 3 including an electronic part housing section 2 surrounded by a perimeter wall projected from the four sides of a rectangular bottom plate; and multiple contacts 5, 5 that include an elastic contact piece 5*a* that elastically forms a contact with the terminals of an electronic part 4, e.g., a camera module or a semiconductor element. The electronic part 4, e.g., a camera module, is supported in the electronic part housing section 2 so that the terminals of the electronic part 4 come into contact with the elastic contact pieces 5*a* of the contacts 5, thus providing an electrical connection with a printed circuit substrate 6 by way of the contacts 5.

Also, the electronic part attachment socket 1 is equipped with a metal securing piece 7 including an elastic support piece 7*a* projecting from the perimeter walls. When the electronic part 4 is inserted into the electronic part housing section 2 while pushing open the elastic support pieces 7*a*, the ends of the elastic support pieces 7*a* are elastically restored and engage with the upper edge of the electronic part 4 so that the electronic part 4 is attached in the electronic part holding section 2. For example, Japanese Laid-Open Patent Publication Number 2003-092168 discloses a conventional housing.

However, in the conventional technology described above, the installation space needed for the metal securing piece led to an increased thickness in the perimeter walls of the socket housing, making it difficult to achieve a compact design.

Also, even if electronic parts have the same terminal arrangement and outer dimensions, if their heights are different, i.e., the height of the section where the elastic support pieces of the metal securing pieces engage, then it is necessarily to form different metal securing tools, socket housings, and shield members that increases production costs.

The object of the present invention is to overcome these problems of the conventional technology and to provide an electronic part attachment socket that is inexpensive, that allows a compact design, and that allows parts to be shared.

SUMMARY OF THE INVENTION

In order to overcome the problems of the conventional technology described above, the invention provides an electronic part attachment socket for connecting an electronic part to a printed circuit substrate by way of a plurality of contacts. This includes a socket housing having an electronic part housing section with an open top in which all or part of the electronic part is housed; and a plurality of contacts elastically contacting a terminal of the electronic part. An electronic part attachment socket has a shield case formed in a box shape fitting an outer perimeter of the socket housing in a manner that prevents slipping off. The shield case is formed integrally with an inwardly projecting pushing section. The shield case is fitted to the socket housing in a manner that prevents it from slipping off so that the pushing section pushes the electronic part toward the contacts and the electronic part is supported in the electronic part housing section.

In addition to the structure above, the shield case includes a flat ceiling plate; main side wall plates formed integrally via bends from four sides of the ceiling plate; and secondary side wall plates formed by bending side edges on one side of each of the main side wall plates and forming a section of an adjacent side wall.

An additional embodiment includes the pushing section formed by overlapping a pair of push pieces bent from abutted edges of the main side wall plate and the secondary side wall plate.

The electronic part attachment socket of the present invention includes a shield case formed in a box shape fitting an outer perimeter of the socket housing in a manner that prevents slipping off. The shield case is formed integrally with an inwardly projecting pushing section. The shield case is fitted to the socket housing in a manner that prevents it from slipping off so that the pushing section pushes the electronic part toward the contacts and the electronic part is supported in the electronic part housing section. As a result, there is no need to provide a metal securing piece as in the conventional technology, allowing the socket housing to be that much more compact and allowing the overall socket to be compact.

Also, even if the positioning and outer dimensions of the terminals of electronic parts are the same but the heights are different, compatibility can be maintained simply by changing the shape of the shield case. This makes it possible to share parts such as socket housings and contacts, allowing costs to be kept down.

By forming the shield case to include a fiat ceiling plate; main side wall plates formed integrally via bends from four sides of the ceiling plate; and secondary side wall plates formed by bending side edges on one side of each of the main side wall plates and forming a section of an adjacent side wall, the need to overlap the shield members at the four corners is eliminated. Thus, the radius of the four corners can be reduced and the overall socket can be made more compact.

Furthermore, the pushing section is formed by overlapping a pair of push pieces bent from abutted edges of the main side wall plate and the secondary side wall plate. This makes it possible to provide adequate strength for pushing the electronic part.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 10(*b*) is a front-view drawing of the shield case in FIG. 1;

FIG. 10(*c*) is a bottom-view drawing of the shield case in FIG. 1;

FIG. 12(*b*) is a front-view drawing of the contact of the present invention;

FIG. 12(*c*) is a bottom-view drawing of the contact in FIG. 1;

FIG. 12(*d*) is a side-view drawing of the contact of the present invention;

FIG. 13(*b*) is a cross-section drawing along the A—A line of FIG. 13(*a*)

DETAILED DESCRIPTION OF THE PREFERRED EMBODIMENTS

The electronic part attachment socket according to the present invention will be described using FIG. 1 through FIG. 13. Parts identical to what is described above will be assigned like numerals and corresponding descriptions will be omitted.

Figure 1:
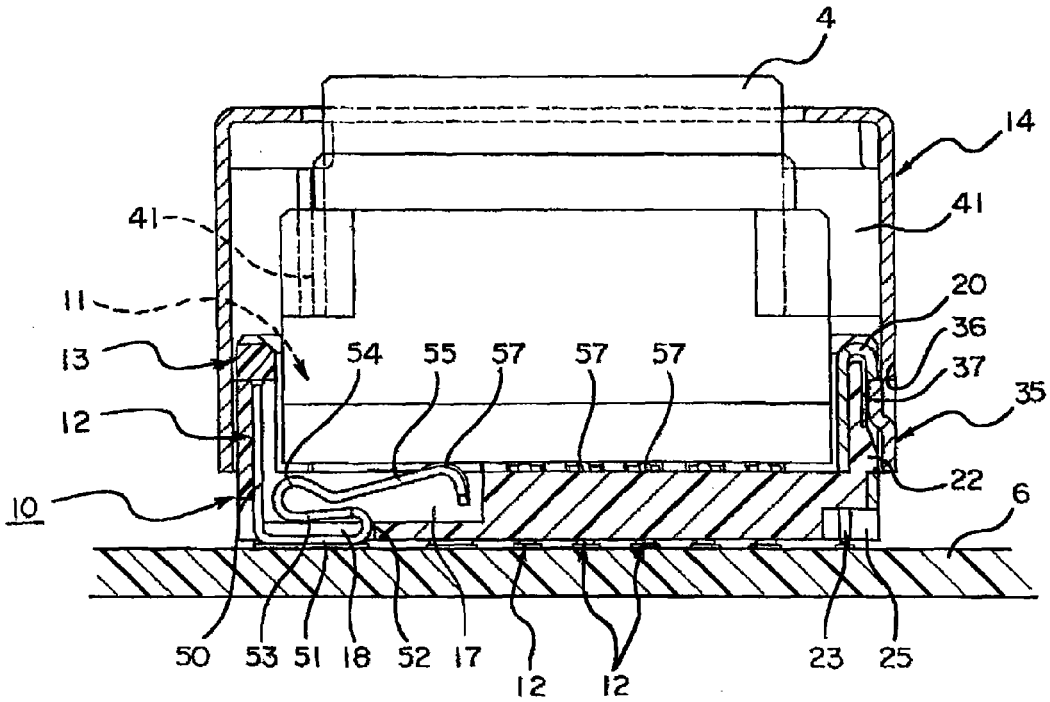
FIG. 1 is a cross-section drawing showing the electronic part socket according to the present invention in use.
Figure 2:
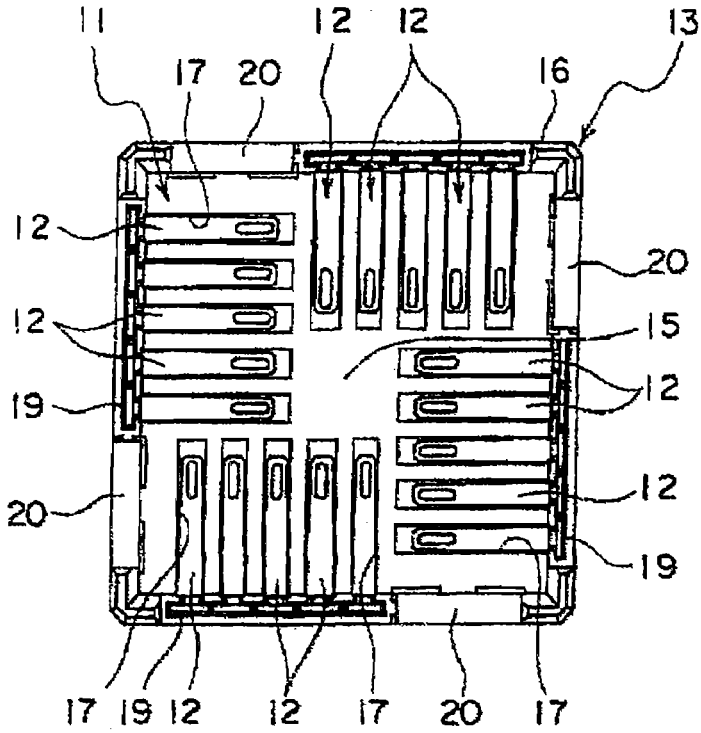
FIG. 2 is a plan drawing showing contacts and shield assistance members attached to the socket housing in FIG. 1.
Figure 3:
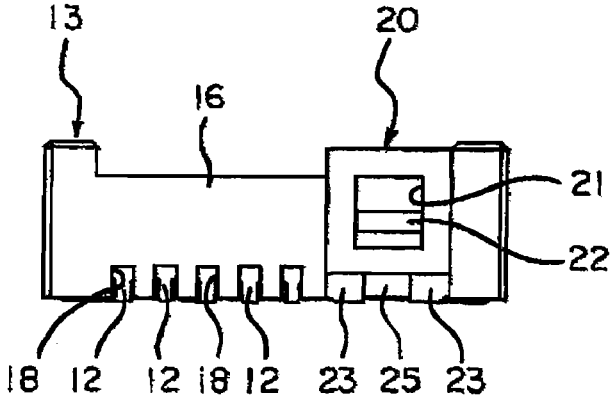
FIG. 3 is a front-view drawing of the present invention of FIG. 1.
Figure 4:
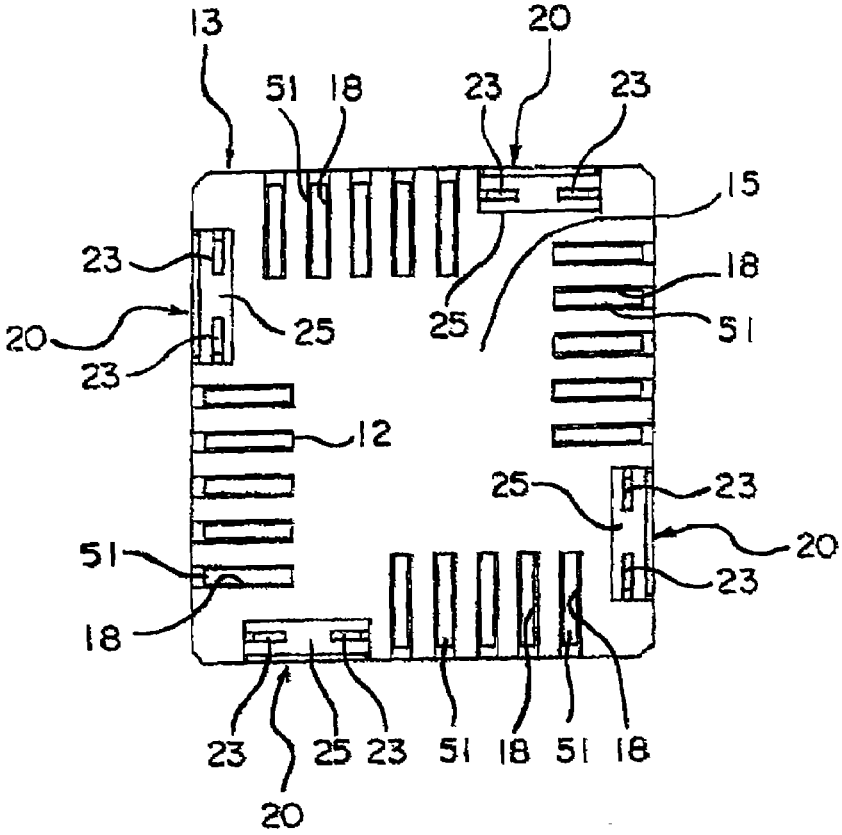
FIG. 4 is a bottom-view drawing of the present invention of FIG. 1.
Figure 5:
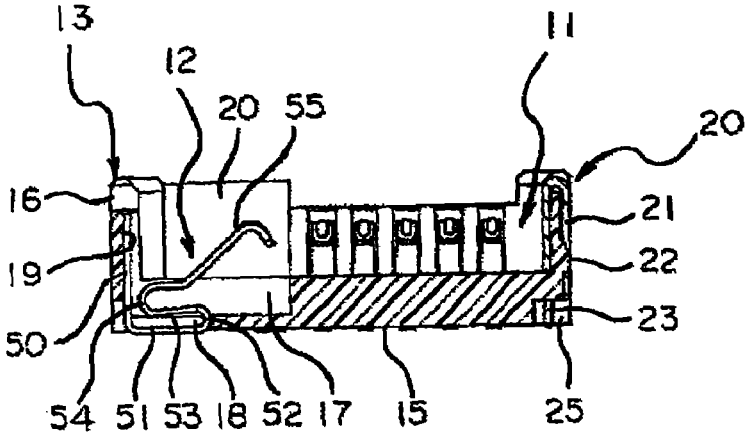
FIG. 5 is a cross-section drawing of the present invention of FIG. 1.
Figure 6:
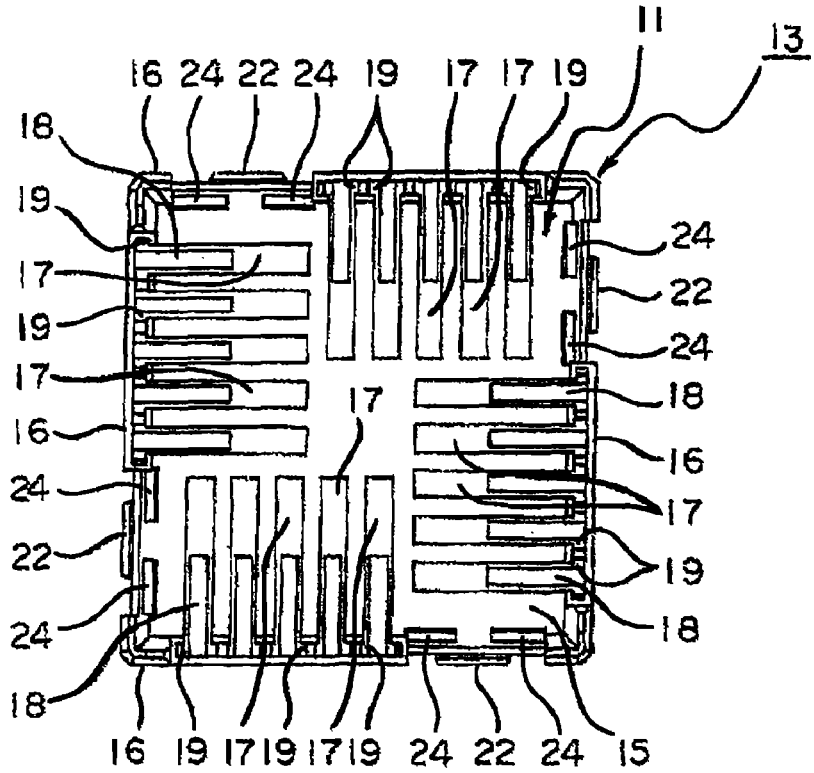
FIG. 6 is a plan drawing of the socket housing.
Figure 7:
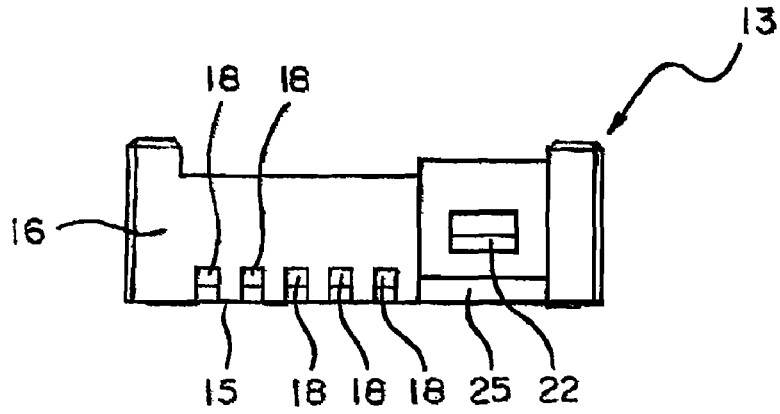
FIG. 7 is a front-view drawing of the present invention of FIG. 1.
Figure 8:
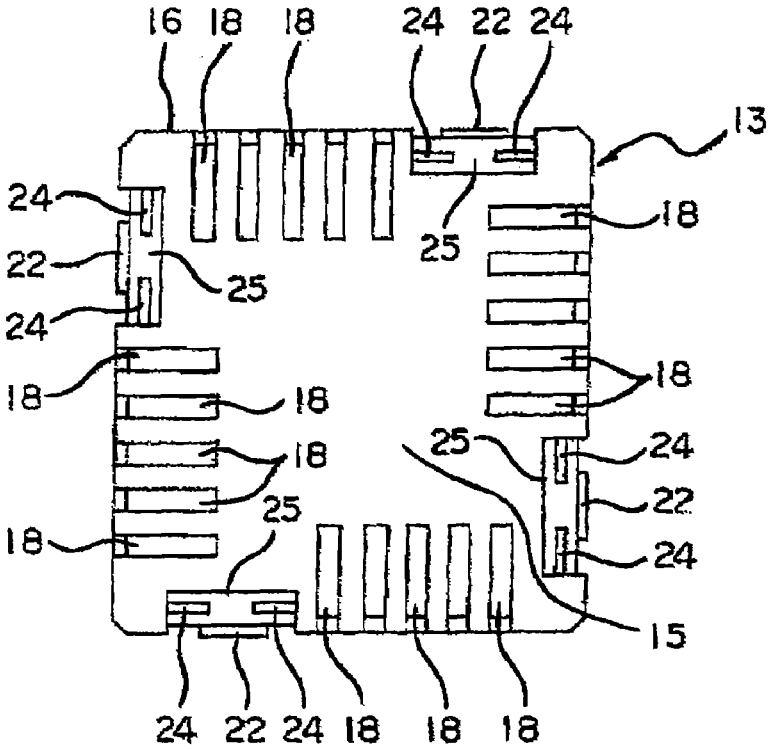
FIG. 8 is a bottom-view drawing of the present invention of FIG. 1.
Figure 9:
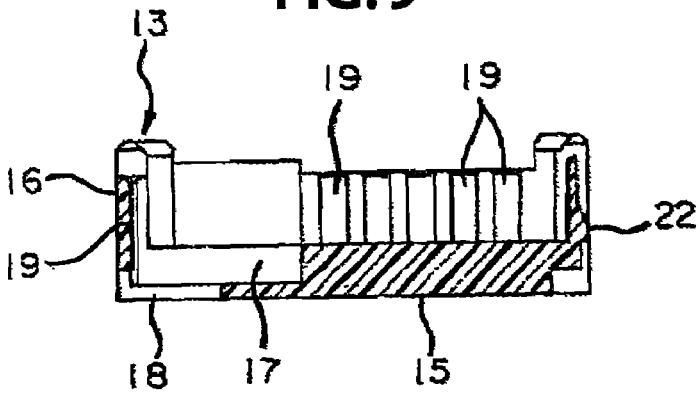
FIG. 9 is a vertical cross-section drawing of the present invention of FIG. 1.

FIG. 1 shows an electronic part such as a camera module being used by being attached to a printed circuit substrate by way of an electronic part attachment socket. The figure shows an electronic part attachment socket 10, a camera module 4, and a printed circuit substrate 6.

The electronic part attachment module 10 is equipped with a socket housing 13 including an electronic part housing section 11 with an open upper surface allowing all or part of the electronic part 4 to be housed; and contacts 12, supported by the socket housing 13. The electronic part 4 housed in the electronic part housing section 11 is connected to the printed circuit substrate 6 by way of the contacts 12.

The electronic part attachment module 10 is equipped with a box-shaped shield case 15 that is fitted to the outer perimeter section of the socket housing 13. This shield case 14 provides shielding.

As shown in FIG. 6 through FIG. 9, the socket housing 13 includes a square base plate 15 and a perimeter wall 16 projected from the four sides of the base plate 15, these parts being formed integrally from an insulative material, e.g., synthetic resin. The base plate 15 and the perimeter wall 16 form the electronic part housing section 11 in which the electronic part 4 is housed.

In socket housing 13, there are formed on the bottom plate of the electronic part housing section 11, i.e., the bottom plate 15 of the socket housing, multiple contact housing grooves, which open to the top and bottom. These grooves are formed in a long, thin shape, oriented length-wise toward the opposite side of the four sides of the bottom plate 15, and somewhat shorter than half the distance between opposing perimeter walls.

The contact housing grooves open to the bottom surface of the socket housing and include a terminal piece housing section 18 housing a terminal piece of the contact and an elastic contact piece housing section 17 housing the elastic contact piece of a contact and an intermediate spring piece. The elastic contact piece housing section 17 is formed wider than the terminal piece housing section 18.

The contact housing grooves form contact housing groove groups that are arranged parallel to each other and point toward the opposing side of the four sides of the bottom plate 15. The contact housing groove groups of adjacent sides of the four sides of the bottom plate 15 are arranged so that the ends of one of the contact housing groove groups points toward the side of the other contact housing groove group.

The contact housing groove group for each side is shifted away from the contact housing groove group that is adjacent by an amount that at least corresponds to the lengthwise dimension of the adjacent housing groove group.

At the center of the bottom plate is formed a flat transport suction section that is surrounded by the ends of the contact housing groove groups. A nozzle is used to suck the transport suction section so that an automated device or the like can transport the device.

The perimeter wall 16 is formed as projections from the four sides of the bottom plate 15 and multiple contact securing holes 19 are formed continuous with the contact housing groove and open on the top to allow insertion of contact securing pieces.

Also, shield assistance members 20 are attached to the sides of each side of the perimeter wall 16, i.e., on the side opposite from the contact housing groove group.

The shield assistance member 20 is formed by folding over a conductive plate, e.g., a plate in which tin-plating has been performed on copper alloy, so that it is secured on the perimeter wall 16 with the perimeter wall 16 being interposed.

The sections of the perimeter wall on which the shield assistance member 20 is attached are formed thin so that combined with the thickness of the shield assistance member 20, the thickness is roughly the same as that of the other sections of the perimeter wall.

Also, an engagement hole 21 is formed on the outer surface of the shield assistance member 20 to engage with a securing projection projecting inward from the shield case 14. Also, a securing projection 22 projecting from the perimeter wall of the socket housing engages with the bottom edge of the engagement hole 21 so that the shield assistance member 20 is secured to the perimeter wall 16.

Furthermore, soldering projection pieces 23 are formed integrally with the inner bottom edge of the shield assistance member 20, and this soldering projection pieces 23 are pushed into push-in holes 24 formed on the bottom plate 15 so that the ends are exposed through cutouts 25 formed on the bottom of the socket housing 13.

Figure 10A:
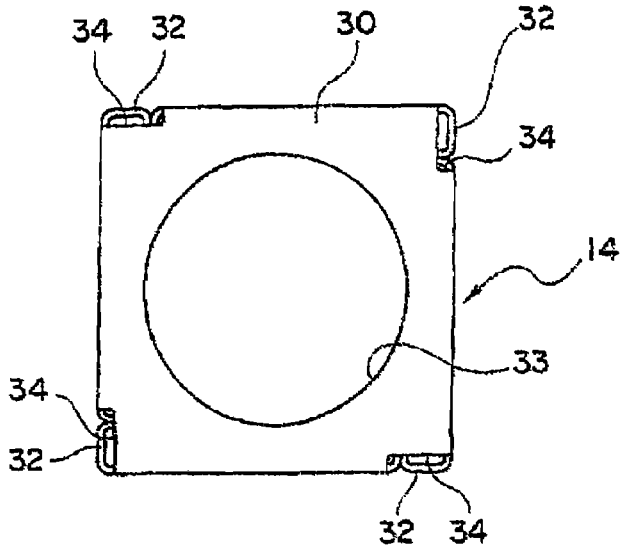
FIG. 10(*a*) is a plan drawing showing the shield case in FIG. 1.
Figure 10B:
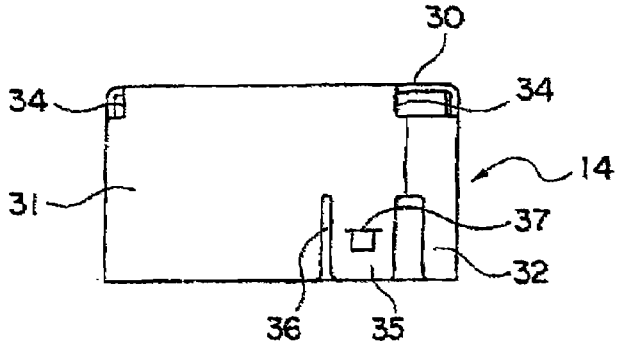
Figure 10C:
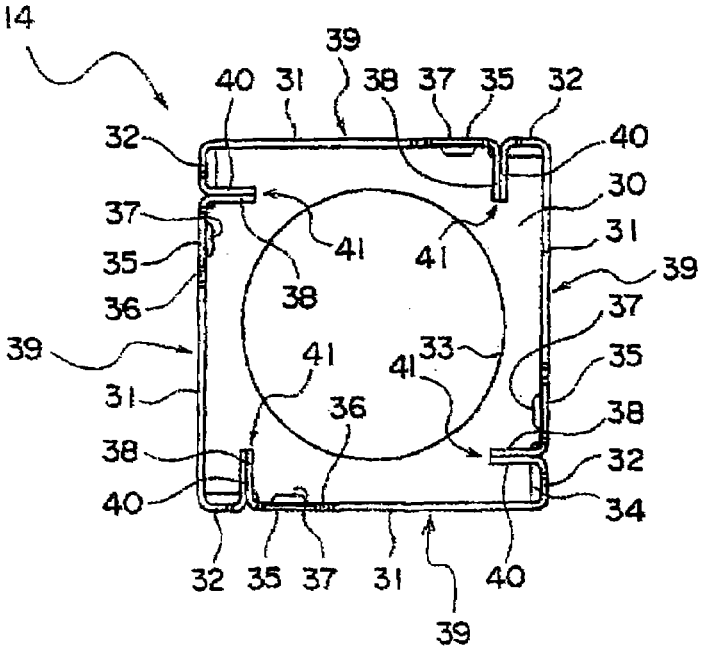
Figure 11:
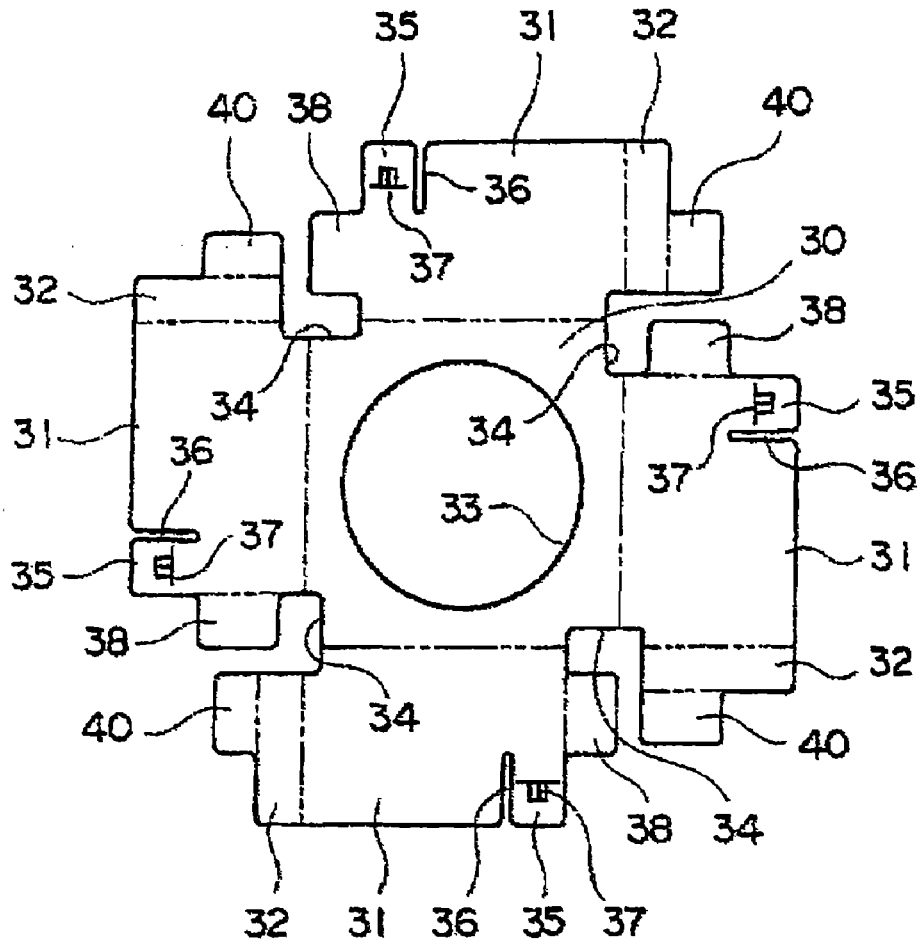
FIG. 11 is an expanded diagram of the shield case.
Figure 12A:
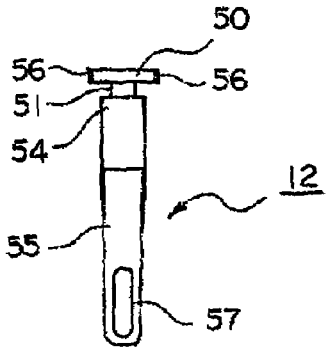
FIG. 12(*a*) is a plan drawing of the contact in FIG. 1.
Figure 12B:
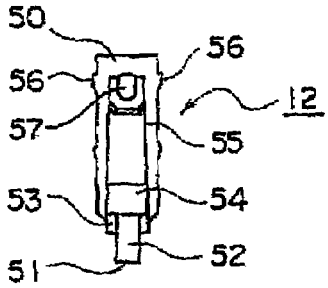
Figure 12C:
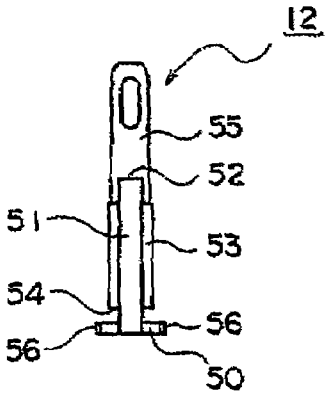
Figure 12D:
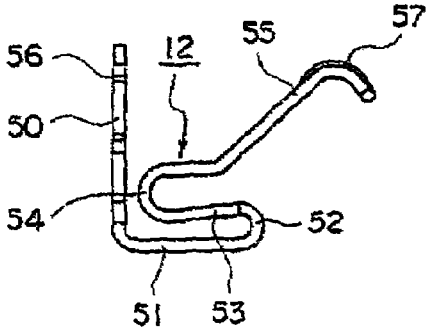

As shown in FIG. 10, the shield case 14 is formed as a box with an open bottom surface. A conductive plate material, e.g., a plate in which copper alloy is plated with tin, is cut as shown in the expanded figure shown in FIG. 11 and then bends are made. The dotted lines in the figure are fold lines.

The shield case 14 includes a flat ceiling plate 30; main side wall plates 31 formed integrally by bends at the four sides of the ceiling plate 30; and secondary side wall plates 32 formed by bends at an edge of each of the main side wall plates 31, i.e., at the same side edges along the perimeter of each main side wall plate 31.

The ceiling plate 30 is formed at the center with an insertion hole 33 through which a section (lens section) of a camera module projects. At the four corners are formed cutouts 34 for bends.

The main side wall plates 31 are formed as flat plates and are formed with elastic engagement sections 35, which are aligned with the positions of the shield assistance member 20 of the socket housing.

The elastic engagement section 35 is formed by forming a slit 36 at the bottom edge of the main side wall plate 31, i.e., from the edge opposite from the bend and in a direction perpendicular to the edge. A securing projection 37 is formed at the center thereof by indenting the plate material inward so that there is an inward projection when the structure is assembled.

On one side edge of each main side wall plate 31 is formed the secondary side wall plate 32 via a bend, and on the other side edge is formed a pushing piece 38 via a bend.

The secondary side wall 32 is bent at the bend line while the edge opposite from the bend line faces the side edge of the adjacent main side wall plate 31, forming part of a side wall 39 for the adjacent side.

At the edge opposite from the bend line of the secondary side wall plate 32 is integrally formed a pushing piece 40 via a bend line.

The pushing pieces 38, 40, which are bent inward at the bend lines, are placed against each other to form a pushing section 41.

As shown in FIG. 12, a contact 12 is integrally formed from a securing piece 50, a terminal piece 51, a first bend 52, an intermediate spring piece 53, a second bend 54, and an elastic contact piece 55. The contact 12 is formed by cutting a metal plate in a predetermined shape and making bends.

The securing piece 50 is oriented vertically relative to the socket housing and the width thereof is formed wider than the width of the contact securing hole.

On the side edges of the securing piece 50 are integrally formed engagement projections 56, 56. When the sides of the securing piece 50 are fitted to the contact securing piece 19, the engagement piece 56 pushes against the side edge of the contact securing piece 19 to prevent slippage, and the contact 12 is attached to the socket housing 13.

The terminal piece 51 is formed as a horizontal bend at the bottom end of the securing piece 50. When the contact 12 is attached to the socket housing, the lower surface is exposed through the lower surface opening of the terminal piece housing section 18 of the socket housing 13.

This terminal piece 51 is formed as a long, thin plate that is narrower than the width of the securing piece 50.

The first bend 52 is formed by bending, in a roughly U shape, the free end of the terminal piece 51, i.e., the side opposite from the securing piece 50. The width of the bend is formed with roughly the same width as the terminal piece 51.

The intermediate spring piece 53 is formed as a flat plate that is continuous with the end opposite from the terminal piece 51 of the first bend 52, and the width thereof is wider than that of the terminal piece 51 and the first bend 52.

The second bend 54 is formed by bending, in a roughly a U shape, the free end of the intermediate spring piece 53, i.e., the side opposite from the first bend 52.

The first bend 52, the intermediate spring piece 53, and the second bend 54 form an S shape when seen from the side.

The elastic contact piece 55 is formed diagonally upward and continuous with the side of the second bend 54 opposite from the intermediate spring piece 53, and the free end thereof is bent at an angle to form a contact section 57 that comes into contact with the terminal of the electronic part 4.

When pressure is received from above, the intermediate spring piece 53 and the elastic contact piece 55 bend at the first bend 52 and the second bend 54 and elastic deformation takes place.

Figure 13A:
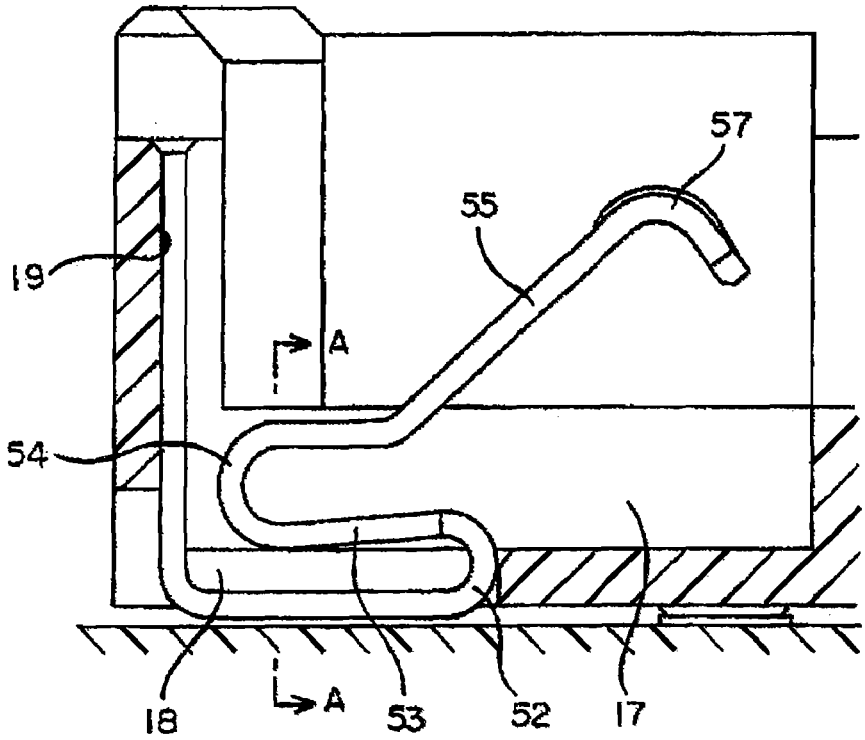
FIG. 13(*a*) is a cross-section showing the contacts attached.
Figure 13B:
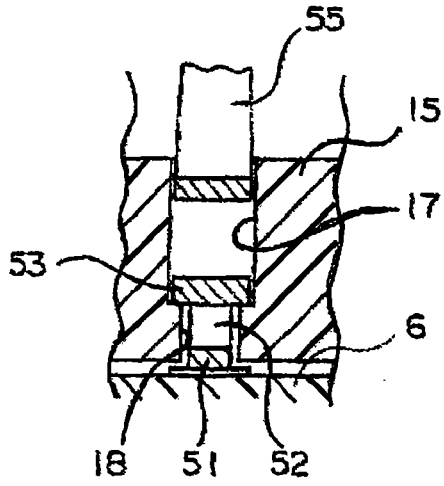
Figure 14:
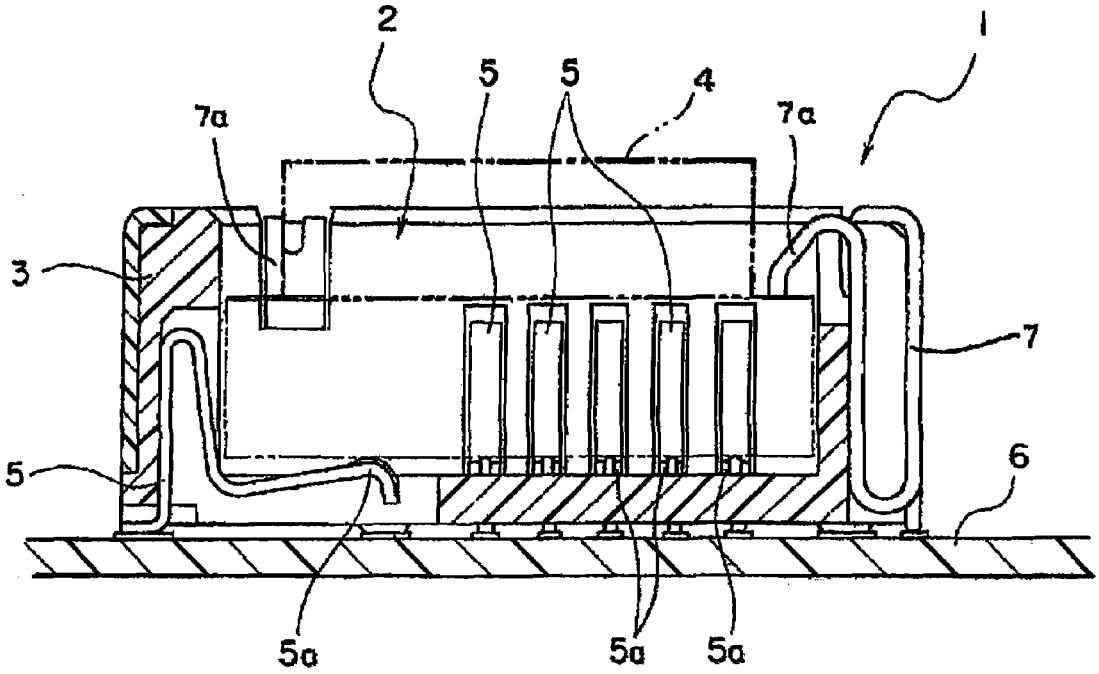
Fig. 14 PRIOR ART
FIG. 14 is a vertical cross-section drawing showing an example of a conventional electronic part attachment socket.

With this contact 12, the securing piece 50 is inserted into the contact securing hole 19 from above the socket housing 13, as shown in FIG. 13. When supported by the socket housing 13, the intermediate spring piece 53 is disposed in the elastic contact piece housing section 17, i.e., the bottom side of the socket housing 13, and the free end of the elastic contact piece 55 projects to the upper side of the bottom plate 15, i.e., into the electronic part housing section 11.

With the electronic part 4 housed in the electronic part housing section 11, the elastic contact piece 55 is able to retract into the elastic contact piece housing section 17 when the elastic contact piece 55 is pushed downward, thus preventing contact with the bottom plate 15.

By forming the elastic contact piece housing section 17 wider than the terminal piece housing section 18 and forming the intermediate spring piece 53 of the contact 12 wider than the terminal piece housing section 18, the first bend 52 is made narrower than the width of the intermediate spring piece 53, the second bend 54, and the elastic contact piece 55, i.e., the elasticity coefficient of the first bend is lower than these so that first, the first bend 52 is elastically deformed and the intermediate spring piece 53 is supported at the bottom surface of the elastic contact piece housing section 17, i.e., at the upper opening edge of the terminal piece housing section 18. This makes it difficult for the stress resulting from the elastic deformation of the elastic contact piece 55 and the intermediate spring piece 53 to transfer to the terminal piece 51, thus maintaining in a favorable manner the connection between the terminal piece 51 with the printed circuit substrate 6, i.e., the solder connection.

The contacts 12 attached to the socket housing 13 form contact groups in which the elastic contact pieces 55 are disposed parallel to each other, extending from one side of the base plate 15 toward the other, facing side.

With the electronic part attachment socket 10 formed in this manner, the electronic part 4 is inserted into the electronic part housing module 11, and is covered by shield case 14. The lower edge of the pushing sections 41 projected into the shield case 14 abuts the upper edge of the electronic part 4.

Then, the securing projections 37 of the elastic engagement sections 35 are pushed down to a position where they engage with the engagement holes 21 of the shield assistance members 20, thus fitting the shield case 14 so that it cannot slip off from the outer perimeter of the socket housing 13. The electronic part 4 is supported in the electronic part housing section 11 with the electronic part 4 pushed downward, i.e., toward the contact side, by the pushing sections 41, and the terminals of the electronic part 4 placed in contact at an appropriate contact pressure with the elastic contact pieces 55 of the contacts 12.

As a result, the electronic part 4 is attached to the electronic part attachment socket 10, the electronic part 4 is shielded, and the electronic part 4 is electrically connected with the printed circuit substrate 6 by way of the electronic part attachment socket 10.

In an embodiment, a camera module is used as the electronic part 4, but it would be possible to use various types of electronic parts such as camera modules, high-frequency electronic parts such as IC chips, other semiconductor elements, and the like.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electronic part attachment socket for connecting an electronic part to a printed circuit substrate by way of a plurality of contacts comprising:

a socket housing having:

an electronic part housing section including an open top, and operable to house at least part of said electronic part; and a plurality of contacts elastically contacting a terminal of said electronic part;

an electronic part attachment socket having:

a shield case formed in a box shape fitting an outer perimeter of said socket housing operable to prevent slipping, said shield case including a ceiling plate integral with main side wall plates and a pushing section inwardly projecting from at least one main side wall plate, the pushing section being perpendicular to the ceiling plate at a first bend located proximate to the main side wall plate, said shield case further including respective secondary side wall plates formed integrally with a respective main side wall plate and disposed on one side of each of said main side wall plates so as to form a section of an adjacent side wall;

wherein said shield case is fitted to said socket housing to prevent slipping, said pushing section pushes said electronic part toward said contacts so as to support said electronic part in said electronic part housing section, and said pushing section is formed by overlapping a pair of push pieces bent from abutted edges of said main side wall plate and said secondary side wall plate.

2. An electronic part attachment socket for connecting an electronic part to a printed circuit substrate by way of a plurality of contacts comprising:

a socket housing, comprising:

an electronic part housing section having an open top, and housing at least part of said electronic part;

a plurality of contacts elastically contacting a terminal of said electronic part;

an electronic part attachment socket comprising:

a shield case formed in a box shape fitting an outer perimeter of said socket housing to prevent slipping;

the shield case further comprising;

a flat ceiling plate;

main side wall plates formed integrally via bends from four sides of said ceiling plate; and secondary side wall plates formed by bending side edges on one side of each of said main side wall plates and a section of an adjacent side wall;

wherein said shield case is formed integrally and having an inwardly projecting pushing section, wherein said pushing section is formed by overlapping a pair of push pieces bent from abutted edges of said main side wall plate and said secondary side wall plate, and wherein said shield case is fitted to said socket housing to prevent slipping and said pushing section pushes said electronic part toward said contacts and said electronic part is supported in said electronic part housing section.

* * * * *